US007624787B2

(12) United States Patent
Lee et al.

(10) Patent No.: US 7,624,787 B2
(45) Date of Patent: Dec. 1, 2009

(54) DISPOSABLE INSERT, AND USE THEREOF IN A METHOD FOR MANUFACTURING AN AIRFOIL

(75) Inventors: Ching-Pang Lee, Cincinnati, OH (US); Hsin-Pang Wang, Rexford, NY (US); Ram Kumar Upadhyay, Niskayuna, NY (US); Paul Richard Myers, Clifton Park, NY (US); Marc Thomas Edgar, Glenmont, NY (US)

(73) Assignee: General Electric Company, Niskayuna, NY (US)

( * ) Notice: Subject to any disclaimer, the term of this patent is extended or adjusted under 35 U.S.C. 154(b) by 53 days.

(21) Appl. No.: 11/567,443

(22) Filed: Dec. 6, 2006

(65) Prior Publication Data

US 2008/0135718 A1 Jun. 12, 2008

(51) Int. Cl.
*B22C 9/00* (2006.01)
*B22C 9/10* (2006.01)

(52) U.S. Cl. ..... 164/516; 164/28; 164/369

(58) Field of Classification Search ..... 164/516, 164/34, 35, 361, 369, 28, 228
See application file for complete search history.

(56) References Cited

U.S. PATENT DOCUMENTS

| | | | | |
|---|---|---|---|---|
| 3,220,972 | A | 11/1965 | Lamoreaux | |
| 3,516,946 | A | 6/1970 | Modic | |
| 3,715,334 | A | 2/1973 | Karstedt | |
| 3,775,452 | A | 11/1973 | Karstedt | |
| 4,288,345 | A | 9/1981 | Ashby et al. | |
| 4,323,756 | A | 4/1982 | Brown et al. | |
| 4,421,153 | A * | 12/1983 | Wilkinson et al. | 164/35 |
| 4,421,903 | A | 12/1983 | Ashby | |
| 4,724,299 | A | 2/1988 | Hammeke | |
| 4,730,093 | A | 3/1988 | Mehta et al. | |
| 5,014,763 | A | 5/1991 | Frank | |
| 5,038,014 | A | 8/1991 | Pratt et al. | |
| 5,043,548 | A | 8/1991 | Whitney et al. | |
| 5,337,568 | A | 8/1994 | Lee et al. | |
| 5,339,888 | A * | 8/1994 | Tanner, Jr. | 164/516 |
| 5,397,215 | A | 3/1995 | Spear et al. | |

(Continued)

FOREIGN PATENT DOCUMENTS

| | | |
|---|---|---|
| EP | 0497682 | 8/1992 |

(Continued)

OTHER PUBLICATIONS

Harvey et al; Non-Axisymmetric Turbine End Wall Design: Part 1 Three-Dimensional Linear Design System; ASME Paper; 99-GT-337; Presented at the International Gas Turbine & Aeroengine Congress & Exhibition, Indianapolis, Indiana; 8 pages; (Jun. 7-Jun. 10, 1999).

(Continued)

*Primary Examiner*—Kevin P Kerns
(74) *Attorney, Agent, or Firm*—Penny A. Clarke

(57) ABSTRACT

A method of forming an integral casting core includes adding a disposable insert to a metal core die and disposing a slurry into the metal core die. The slurry includes ceramic particles. The method further includes firing the slurry to form a integral casting core and removing the disposable insert from the integral casting core.

22 Claims, 6 Drawing Sheets

U.S. PATENT DOCUMENTS

| | | | | |
|---|---|---|---|---|
| 5,868,194 | A * | 2/1999 | Horwood | 164/456 |
| 5,931,638 | A | 8/1999 | Krause et al. | |
| 6,017,186 | A | 1/2000 | Hoeger et al. | |
| 6,142,734 | A * | 11/2000 | Lee | 416/97 R |
| 6,254,334 | B1 | 7/2001 | LaFleur | |
| 6,255,000 | B1 * | 7/2001 | O'Connor et al. | 428/586 |
| 6,269,540 | B1 | 8/2001 | Islam et al. | |
| 6,283,713 | B1 | 9/2001 | Harvey et al. | |
| 6,338,609 | B1 | 1/2002 | Decker et al. | |
| 6,350,404 | B1 | 2/2002 | Li et al. | |
| 6,379,528 | B1 | 4/2002 | Lee et al. | |
| 6,402,464 | B1 | 6/2002 | Chiu et al. | |
| 6,419,446 | B1 | 7/2002 | Kvasnak et al. | |
| 6,429,402 | B1 | 8/2002 | Dixon et al. | |
| 6,502,622 | B2 | 1/2003 | Lee et al. | |
| 6,504,127 | B1 | 1/2003 | McGregor et al. | |
| 6,511,294 | B1 | 1/2003 | Mielke et al. | |
| 6,546,730 | B2 | 4/2003 | Johnson et al. | |
| 6,561,761 | B1 | 5/2003 | Decker et al. | |
| 6,578,623 | B2 * | 6/2003 | Keller et al. | 164/369 |
| 6,588,484 | B1 | 7/2003 | Fosaaen et al. | |
| 6,626,230 | B1 | 9/2003 | Woodrum et al. | |
| 6,669,445 | B2 | 12/2003 | Staubach et al. | |
| 6,974,308 | B2 | 12/2005 | Halfmann et al. | |
| 7,134,842 | B2 | 11/2006 | Tam et al. | |
| 2005/0006047 | A1 | 1/2005 | Wang et al. | |
| 2005/0070651 | A1 | 3/2005 | McNulty et al. | |
| 2005/0156361 | A1 | 7/2005 | Holowczak et al. | |
| 2005/0205232 | A1 | 9/2005 | Wang et al. | |
| 2006/0065383 | A1 | 3/2006 | Ortiz et al. | |
| 2006/0153681 | A1 | 7/2006 | Lee | |
| 2006/0233641 | A1 | 10/2006 | Lee et al. | |
| 2006/0275112 | A1 | 12/2006 | Lee et al. | |
| 2007/0003416 | A1 | 1/2007 | Bewlay et al. | |

FOREIGN PATENT DOCUMENTS

| | | | |
|---|---|---|---|
| GB | 2 090 181 A | * | 7/1982 |
| GB | 2090181 | | 7/1982 |
| GB | 2359042 | | 8/2001 |

OTHER PUBLICATIONS

Krauss et al; "Rheological Properties of Alumina Injection Feedstocks"; Materials Research; 8; pp. 187-189; (2005).

Sieverding; "Secondary Flows in Straight and Annular Turbine Cascades"; in Thermodynamics and Fluid Mechanics of Turbomachinery, vol. II; Eds. A.S. Ucer, P. Stow, and Ch. Hirsch; NATO ASI Series; Martinus Nijhoff Publishers; pp. 621-664; (1985).

Shih et al; "Controlling Secondary-Flow Structure by Leading-Edge Airfoil Fillet and Inlet Swirl to Reduce Aerodynamic Loss and Surface Heat Transfer"; Transactions of the ASME; 125; pp. 48-56; Jan. (2003).

Takeishi et al; "An Experimental Study of the Heat Transfer and Film Cooling on Low Aspect Ratio Turbine Nozzles"; The American Society of Mechanical Engineers, 345 E. 47$^{th}$ St., New York, N.Y. 10017; ASME Paper 89-GT-187; Presented at the Gas Turbine and Aeroengine Congress and Exposition, Jun. 4-8, Toronto, Ontario Canada; 9 pages (1989).

Theiler, et al.; "Deposition of Graded Metal Matrix Composites by Laser Beam Cladding"; BIAS Bremen Institute of Applied Beam Technology, Germany; http://www.bias.de/WM/Publikationen/Deposition%20of%20graded.pdf; 10 pages; Jun. 2005.

U.S. Appl. No. 11/256,823, filed Oct. 24, 2005; "Ceramic-Based Molds for Industrial Gas Turbine Metal Castings Using Gelcasting"; Huang et al.

U.S. Appl. No. 11/540,741, filed Sep. 29, 2006; "Turbine Angel Wing Sealing Using Surface Depression Treatment"; Bunker, Ronald Scott.

U.S. Appl. No. 11/240,837, filed Sep. 30, 2006; "Methods for Making Ceramic Casting Cores and Related Articles and Processes"; H.P. Wang et al.

U.S. Appl. No. 11/567,409, filed Dec. 6, 2006; "Casting Compositions For Manufacturing Metal Castings and Methods of Manufacturing Thereof"; Hsin-Pang Wang et al.

U.S. Appl. No. 11/567,477, filed Dec. 6, 2006; "Composite Core Die, Methods of Manufacture Thereof and Articles Manufactured Therefrom"; Ching-Pang Lee et al.

U.S. Appl. No. 11/567,521, filed Dec. 6, 2006; "Ceramic Cores, Methods of Manufacture Thereof and Articles Manufactured From the Same"; Chin-Pang Lee.

U.S. Appl. No. 11/635,749, filed Dec. 7, 2006; "Processes for the Formation of Positive Features on Shroud Components, and Related Articles"; Ching-Pang Lee.

U.S. Appl. No. 11/609,117, filed Dec. 11, 2006; "Disposable Thin Wall Core Die, Methods of Manufacture Thereof and Articles Manufactured Therefrom"; Hsin-Pang Wang et al.

U.S. Appl. No. 11/609,150, filed Dec. 11, 2006; "Method of Modifying the End Wall Contour in a Turbine Using Laser Consolidation and the Turbines Derived Therefrom" Ching-Pang Lee et al.

EP Search Report, EP07122376, Mar. 5, 2008.

D.T. Plam et al., "A comparison of rapid prototyping technologies," International Journal of Machine Tools & Manufacture, No. 38, 1998, pp. 1257-1287.

* cited by examiner

DISPOSABLE INSERT, AND USE THEREOF IN A METHOD FOR MANUFACTURING AN AIRFOIL

BACKGROUND

This disclosure relates to disposable inserts and uses thereof in a method for manufacturing an airfoil.

Components having complex geometry, such as components having internal passages and voids therein, are difficult to cast using currently available methods. The tooling used for the manufacture of such parts is both expensive and time consuming, often requiring a large lead-time. This situation is exacerbated by the nature of conventional molds comprising a shell and one or more separately formed ceramic cores. The ceramic cores are prone to shift during casting, leading to low casting tolerances and low casting efficiency (yield). Examples of components having complex geometries that are difficult to cast using currently available methods, include hollow airfoils for gas turbine engines, and in particular relatively small, double-walled airfoils. Examples of such airfoils for gas turbine engines include rotor blades and stator vanes of both turbine and compressor sections, or any parts that need internal cooling.

In current methods for casting hollow parts, a ceramic core and shell are produced separately. The ceramic core (for providing the hollow portions of the hollow part) is first manufactured by pouring a slurry that comprises a ceramic into a metal core die. After curing and firing, the slurry is solidified to form the ceramic core. The ceramic core is then encased in wax and a ceramic shell is formed around the wax pattern. The wax that encases the ceramic core is then removed to form a ceramic mold in which a metal part may be cast. These current methods are expensive, have long lead-times, and have the disadvantage of low casting yields due to lack of reliable registration between the core and shell that permits movement of the core relative to the shell during the filling of the ceramic mold with molten metal. In the case of hollow airfoils, another disadvantage of such methods is that any holes that are desired in the casting are formed in an expensive, separate step after forming the cast part, for example, by electron discharge machining (EDM) or laser drilling.

Development time and cost for airfoils are often increased because such components generally require several iterations, sometimes while the part is in production. To meet durability requirements, turbine airfoils are often designed with increased thickness and with increased cooling airflow capability in an attempt to compensate for poor casting tolerance, resulting in decreased engine efficiency and lower engine thrust. Improved methods for casting turbine airfoils will enable propulsion systems with greater range and greater durability, while providing improved airfoil cooling efficiency and greater dimensional stability.

Double wall construction and narrow secondary flow channels in modern airfoils add to the complexity of the already complex ceramic cores used in casting of turbine airfoils. Since the ceramic core identically matches the various internal voids in the airfoil which represent the various cooling channels and features it becomes correspondingly more complex as the cooling circuit increases in complexity. The double wall construction is difficult to manufacture because the conventional core die cannot be used to form a complete integral ceramic core. Instead, the ceramic core is manufactured as multiple separate pieces and then assembled into the complete integral ceramic core. This method of manufacture is therefore a time consuming and low yielding process.

Accordingly, there is a need in the field to have an improved process that accurately produces the complete integral ceramic core for double wall airfoil casting.

SUMMARY

Disclosed herein is a method of forming an integral casting core comprising adding a disposable insert to a metal core die; disposing a slurry in to the metal core die; wherein the slurry comprises ceramic particles; and firing the slurry to form a integral casting core; wherein the disposable insert is removed from the integral casting core during the firing of the slurry.

Disclosed herein too is a method comprising adding a disposable insert to a metal core die; wherein the disposable insert comprises a wax; disposing a slurry in to the metal core die; wherein the slurry comprises ceramic particles; firing the slurry in a first firing process to form a integral casting core; wherein the disposable insert is removed from the integral casting core during the firing of the slurry; disposing the integral casting core into a wax die; wherein the wax die comprises a metal surface; injecting a wax into the wax die to form a wax component; immersing the wax component into a slurry to form an outer shell; and firing the wax component with the outer shell in a second firing process to form a ceramic shell; removing the wax from the outer shell and the wax component; disposing a molten metal into the outer shell; and removing the outer shell to yield a molded component.

Disclosed herein too is a metal core die comprising a cured ceramic core defining a plurality of channels for a double-walled airfoil; and a disposable insert defining a main sidewall, an internal wall, or a combination comprising at least one of a main sidewall and an internal wall.

DETAILED DESCRIPTION

Figure 1:
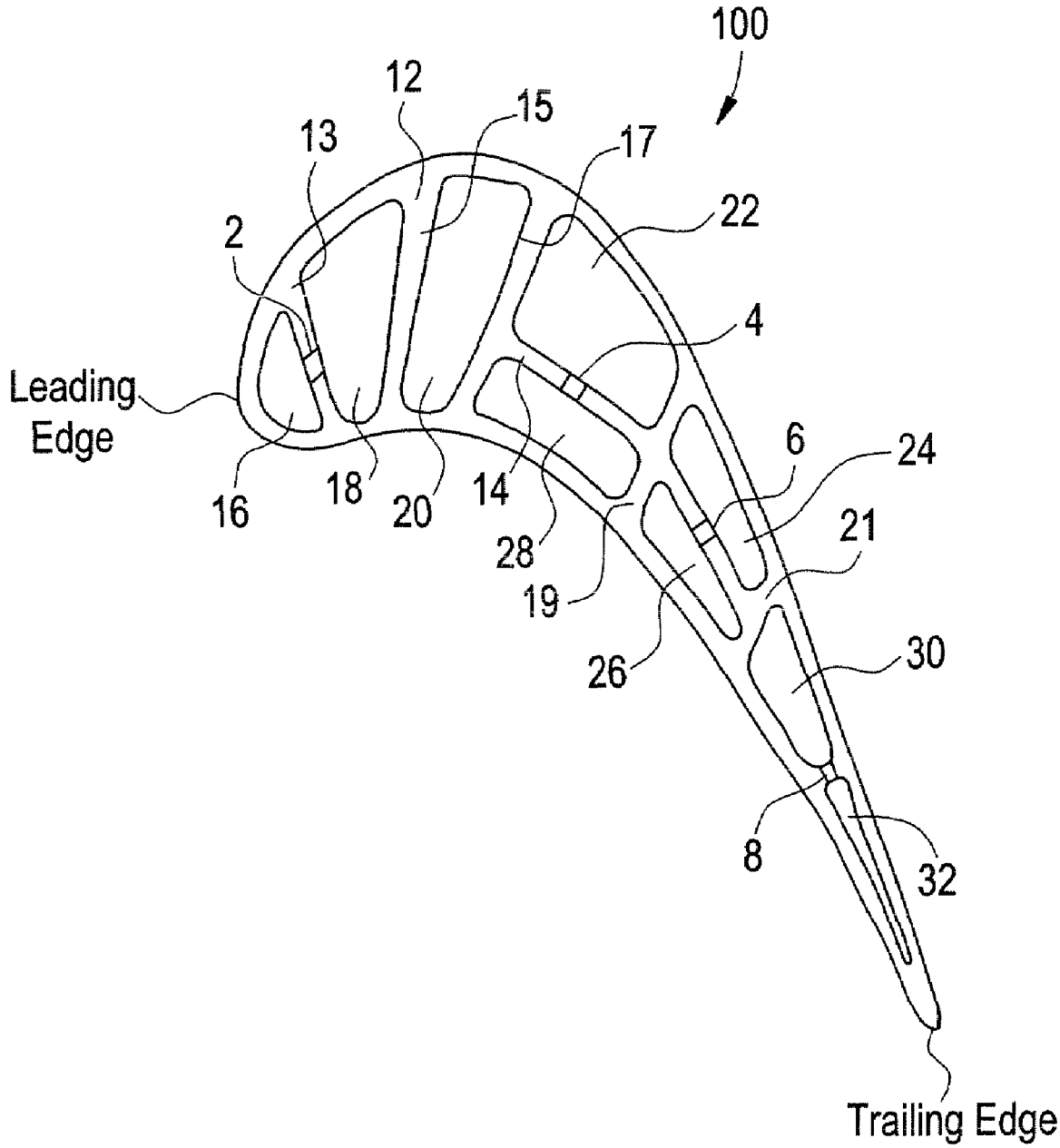
FIG. 1 is an exemplary schematic of a double wall turbine airfoil that can be manufactured by using a disposable insert.

The use of the terms "a" and "an" and "the" and similar references in the context of describing the invention (especially in the context of the following claims) are to be construed to cover both the singular and the plural, unless otherwise indicated herein or clearly contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Disclosed herein is a method of manufacturing a component by using a disposable insert during the process of manufacturing a ceramic core. The ceramic core is further used to obtain a casting of the component. The component can comprise a metal, a ceramic or an organic polymer.

The use of a disposable insert is advantageous in that it decreases time between iterations in casting ceramic cores, and reduces production lead-time. The disposable insert also provides for the production of a complete integral ceramic core without the assembly of a plurality of smaller ceramic cores. The disposable insert can be advantageously used to manufacture turbine airfoils. The disposable insert generally imparts simple configurations to the internal or external portions of the airfoil. It can be mass-produced by process such as rapid prototyping. As will be explained in detail below, the insert is removable after the core die is opened.

In one embodiment, the method comprises manufacturing a first disposable insert. The disposable insert is used in conjunction with the metal core die to create an integral casting core die prior to the injection of a slurry into the metal core die. After disposing the disposable insert into the metal core die, the opposing portions of the metal core die are brought together to be in intimate contact with one another and sealed. A slurry that comprises a ceramic powder is injected into the metal core die with the disposable insert disposed therein. Following gelation of the ceramic slurry, the resulting cured ceramic core containing the insert is removed from the metal core die and subjected to a first firing process at an elevated temperature. The firing results in consolidation of the cured ceramic core into a solidified ceramic core. The solidified ceramic core is also termed the integral casting core. During the conversion of the cured ceramic core into the integral casting core, the disposable insert is also degraded (either thermally, chemically or mechanically) and thus removed.

The solidified ceramic core is then disposed inside a wax die. The wax die is made from a metal. Wax is injected between the solidified ceramic core and the metal and allowed to cool. The wax die is then removed leaving behind a wax component with the ceramic core enclosed therein. The wax component is then subjected to an investment casting process wherein it is repeatedly immersed into a ceramic slurry to form a ceramic slurry coat whose an inner surface corresponds in geometry to the outer surface of the desired component. The wax component disposed inside the ceramic slurry coat is then subjected to a second firing process wherein the wax is removed leaving behind a ceramic mold. Molten metal may then be poured into the ceramic mold to create a desired metal component. As noted above, the component can be a turbine component such as, for example, a turbine airfoil.

With reference now to the FIG. 1, an exemplary double wall turbine airfoil 100 comprises a main sidewall 12 that encloses the entire turbine airfoil. The airfoil depicted in FIG. 1 is illustrative, and the invention is not limited a specific airfoil configuration. As may be seen in the FIG. 1, the main sidewall 12 comprises a leading edge and a trailing edge. Within the main sidewall 12 is a thin internal wall 14. The main sidewall 12 and the thin internal wall 14 (or partition wall) together form the double wall. As may be seen, the airfoil comprises a plurality of channel partition ribs 13, 15, 17, 19 and 21. The double wall construction is formed between channel partition ribs 17, 19 and 21 whose ends are affixed to the main sidewalls. As can be seen in the FIG. 1, there are a plurality of channels (also termed impingement cavities) 16, 18, 20, 22, 24, 26, 28, 30 and 32 formed between the main sidewall 12, the ribs and the thin internal wall 14. The channels permit the flow of a fluid such as air to effect cooling of the airfoil. There are a number of impingement cross-over holes disposed in the ribs such as the leading edge impingement cross-over holes 2, the mid-circuit double wall impingement cross over holes 4, 6, and the trailing edge impingement cross-over holes 8 through which air can also flow to effect a cooling of the airfoil.

As may be seen in the FIG. 1, the exemplary double wall airfoil comprises four impingement cavities 22, 24, 26 and 28 in the mid-chord region. The impingement cavities 22, 24, 26 and 28 are formed between the main sidewall 12 and the thin internal wall 14. In one embodiment, any portion of the airfoil, such as, for example, the main sidewall 12, the thin internal wall 14, or the channel partition ribs 13, 15, 17, 19 and 21 may be manufactured via the use of a sacrificial die (hereinafter a disposable insert). In an exemplary embodiment depicted in the following figures, the thin internal wall 14 may be manufactured via the use of a disposable insert.

Figure 2:
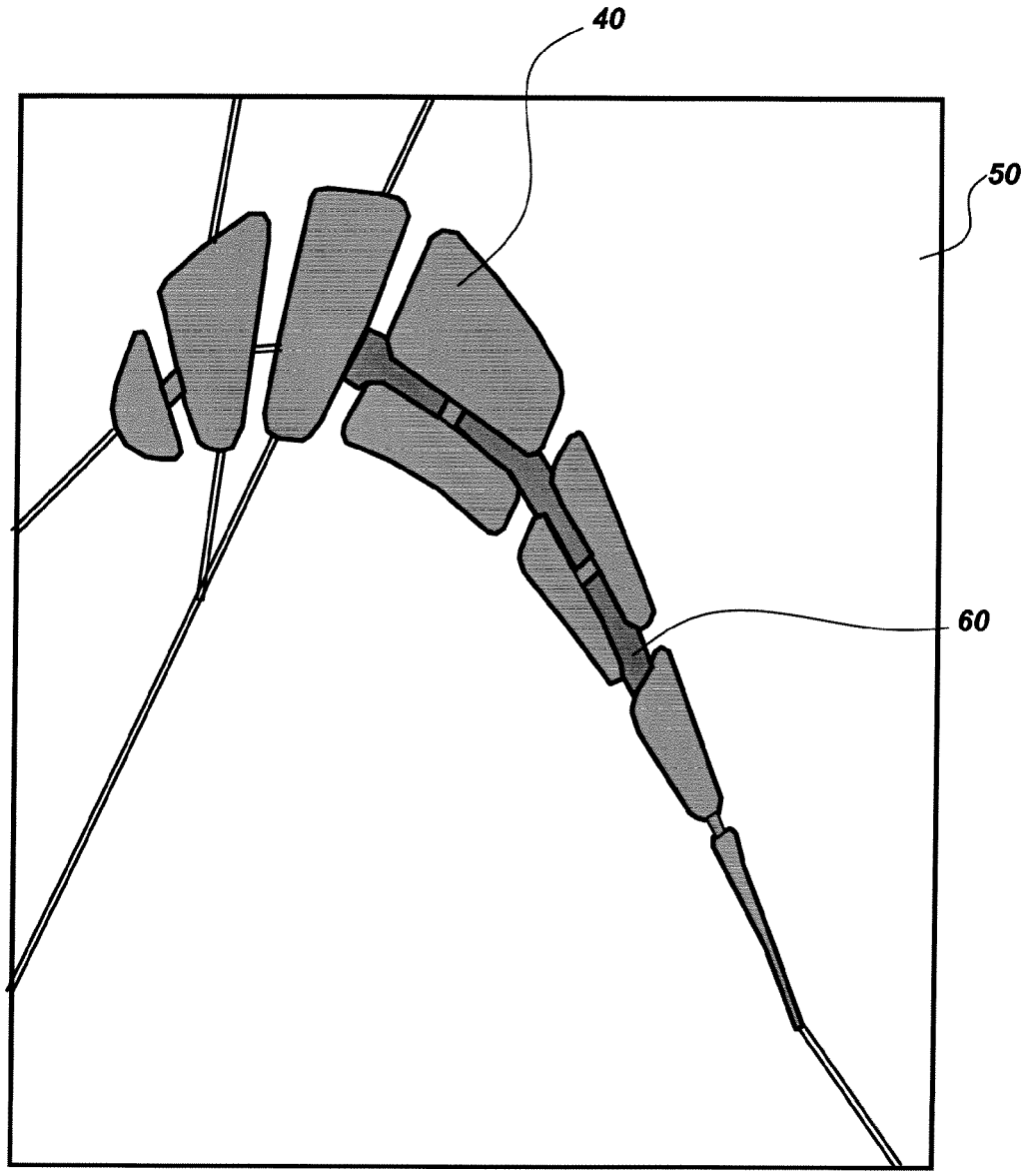
FIG. 2 depicts an exemplary embodiment of a metal core die comprising a cured ceramic core and the disposable insert.

With reference now to the FIG. 2, which depicts an exemplary embodiment of this disclosure, a metal core die 50 comprising the cured ceramic core 40 and the disposable insert 60 is shown. In accomplishing the embodiment depicted in the FIG. 2, a disposable insert 60 comprising a wax is disposed in the metal core die 50. The disposable insert 60 may comprise a polymer or a wax-polymer composite in lieu of the wax, if desired. The metal core die 50 is closed or sealed and a slurry comprising ceramic particles is then poured into the metal core die 50. The closing or sealing of the constituent parts (not shown) of the metal core die 50 prohibits leakage of slurry from the die 50. The slurry is then cured to form a cured ceramic core 40. The cured ceramic core 40 surrounds the disposable insert 60.

Figure 3:
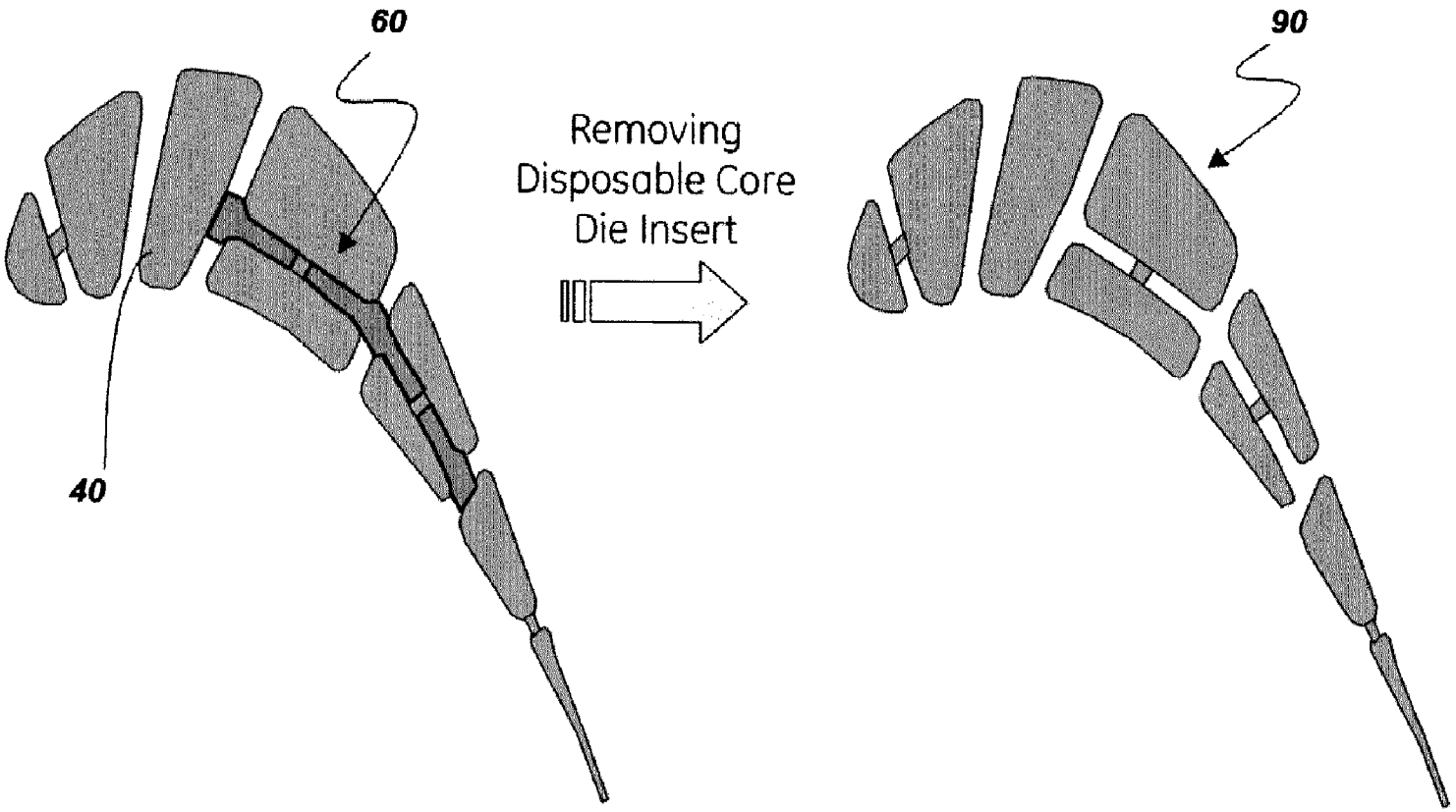
FIG. 3 depicts the cured ceramic core, which is then fired to form a solidified ceramic core called an integral casting core.

As can be seen in the FIG. 3, the cured ceramic core 40 is then fired to form a solidified ceramic core called the integral casting core 90. During or after the firing, the disposable insert 60 can be removed. If the disposable insert 60 is removed during the firing, it is generally melted away or thermally degraded.

In another embodiment, the disposable insert 60 can be removed after the firing to yield the integral casting core 90. This generally involves the use of chemicals or mechanical methods to remove the disposable insert 60. In this embodiment, the act of removing the disposable insert using a chemical generally involves dissolution or degradation of the organic polymer used as a binder in the disposable insert. The act of removing the disposable insert using a mechanical method generally involves abrasion.

Figure 4:
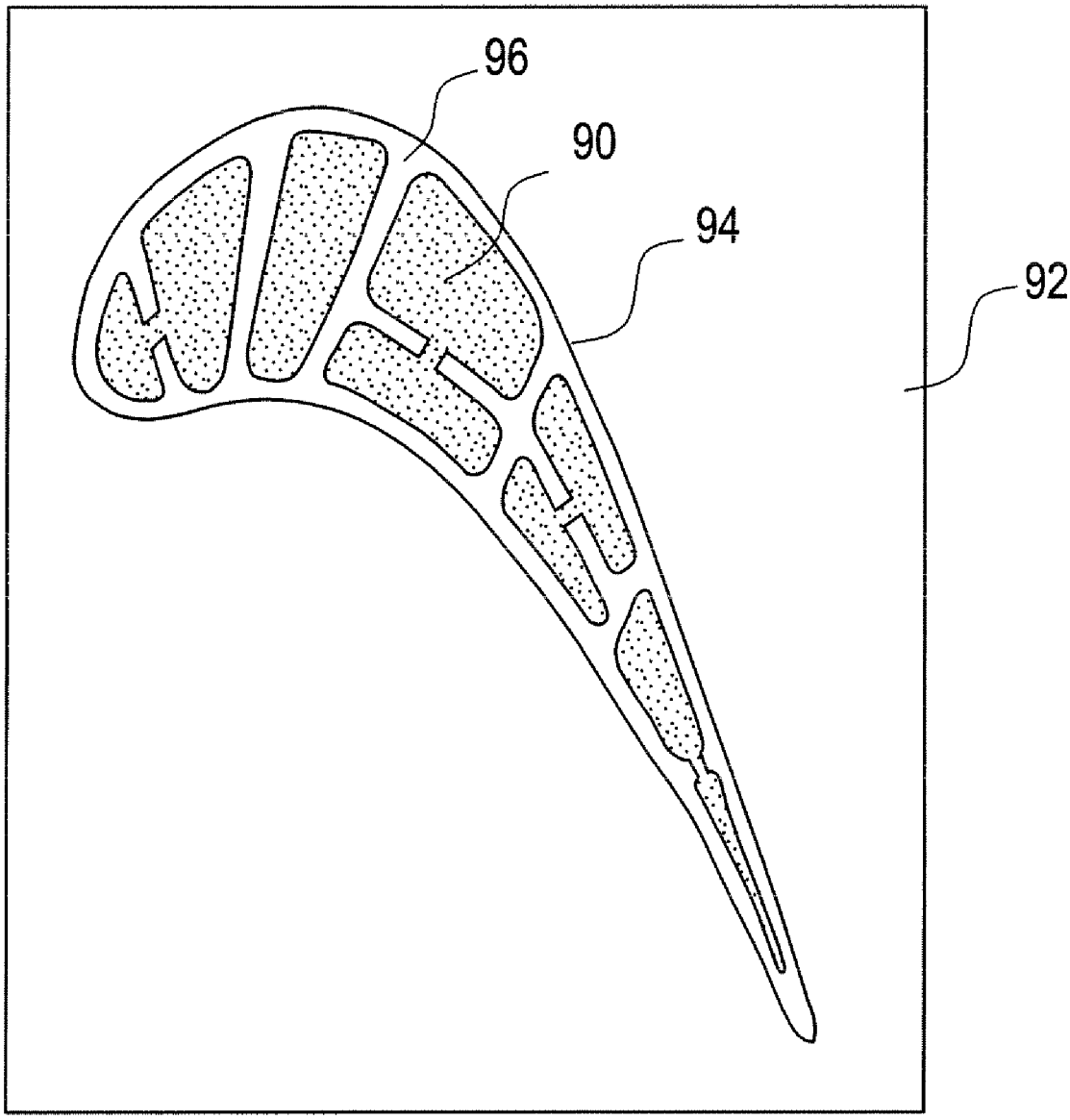
FIG. 4 depicts a wax die that includes the integral casting core.
Figure 5:
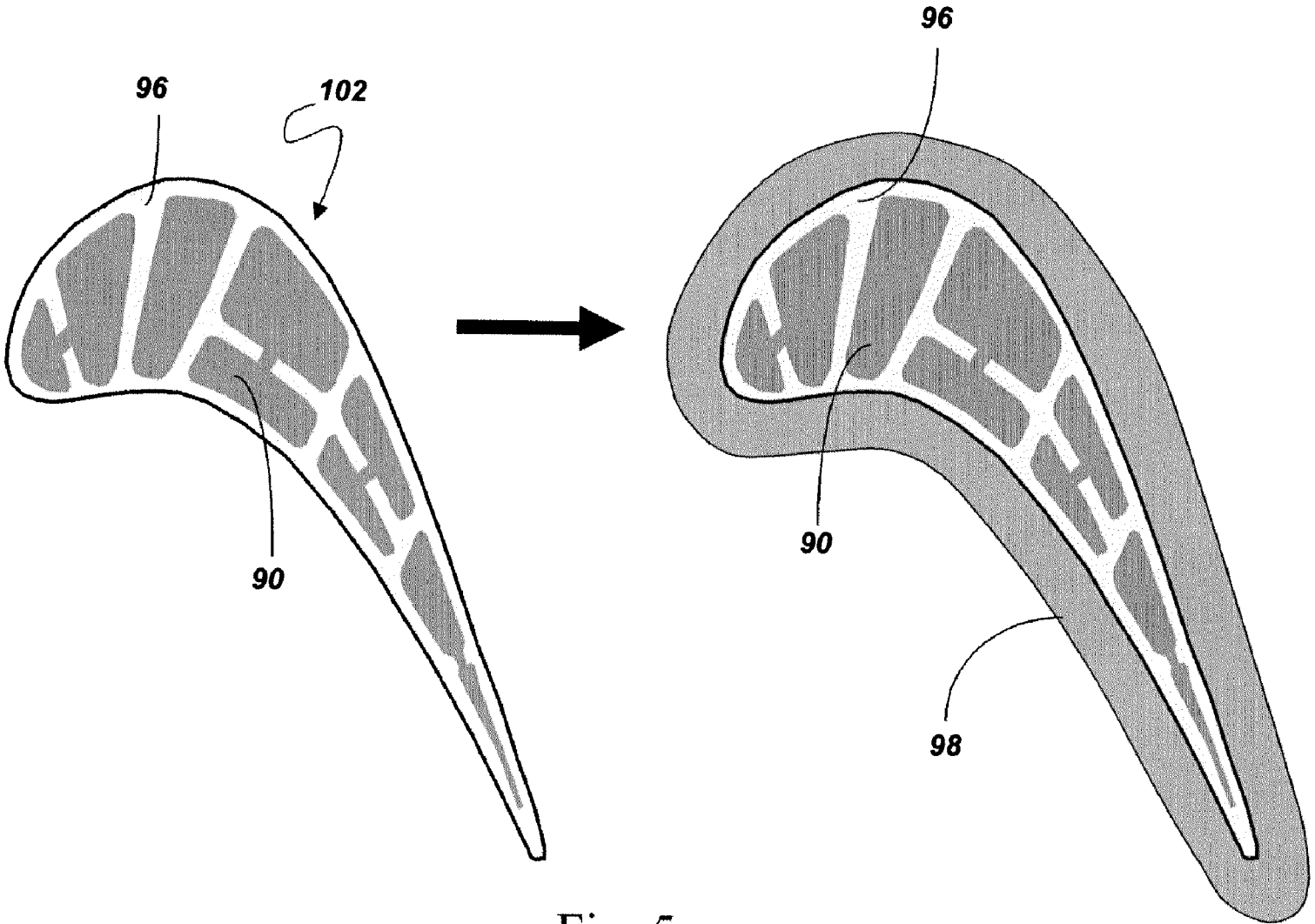
FIG. 5 depicts a ceramic shell created by the immersion of a wax airfoil in a ceramic slurry.

Following the removal of the disposable insert the integral casting core 90 is inserted into a wax die 92 as depicted in the FIG. 4. The wax die 92 has an inner surface 94 that corresponds to the desired outer surface of the turbine airfoil. Molten wax 96 is then poured into the wax die as shown in the FIG. 4. Upon solidification of the wax, the wax airfoil 102 shown in the FIG. 5 is removed from the wax die 92 and repeatedly immersed in a ceramic slurry to create a ceramic shell 98.

Figure 6:
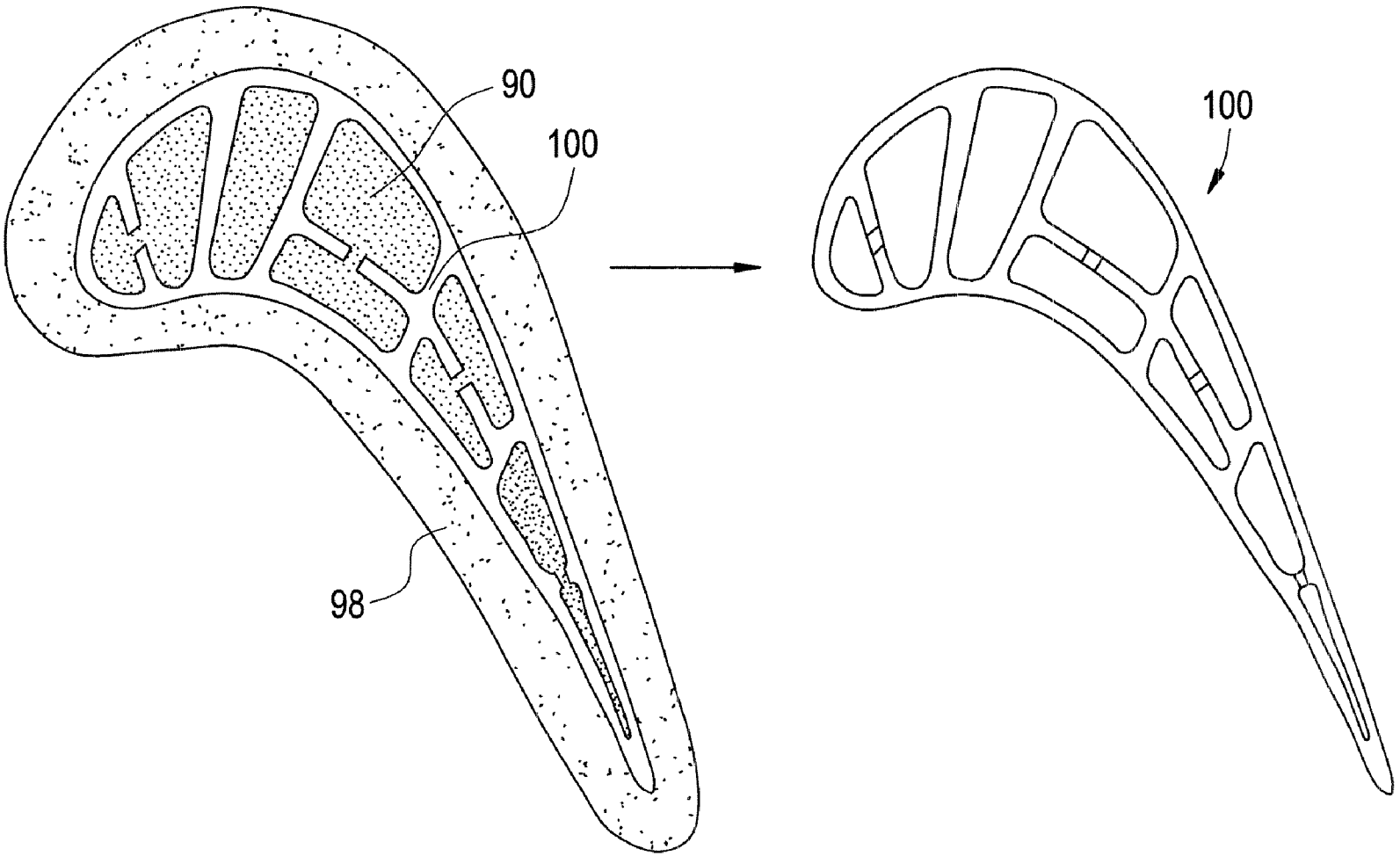
FIG. 6 is an exemplary depiction showing the airfoil (molded component) after removal of the ceramic shell and the integral casting core.

The wax present in the wax airfoil 102 is then removed by melting it and permitting it to flow out of the ceramic shell 98 that comprises the integral casting core 90. After the wax is removed a molten metal, ceramic or polymer may be poured into the ceramic shell 98 that comprises the integral casting core 90. In an exemplary embodiment, a molten metal is poured into the ceramic shell 98 to form the airfoil as depicted in the FIG. 6. FIG. 6 shows the ceramic shell 98 after the molten metal is disposed in it. Following the cooling and solidification of the metal, the ceramic shell 98 is broken to remove the desired airfoil. The integral casting core is then removed via chemical leaching.

Thus the disposable insert can advantageously be used to manufacture airfoils having a double wall design. In the aforementioned FIGS. 1 to 6, the disposable insert was used to form the partition wall 14 in the double wall blade design. The disposable inserts can be used in the metal core dies in order to produce an integral casting core without further assembly. The use of a disposable insert therefore produces higher yields and lowers costs.

In one exemplary embodiment, a plurality of disposable inserts can be used in the integral casting core. A plurality is defined as any number greater than 1.

The disposable insert 60 is generally manufactured from an insert casting composition that comprises an organic polymer. The organic polymer can be selected from a wide variety of thermoplastic polymers, thermosetting polymers, blends of thermoplastic polymers, or blends of thermoplastic polymers with thermosetting polymers. The organic polymer can comprise a homopolymer, a copolymer such as a star block copolymer, a graft copolymer, an alternating block copolymer or a random copolymer, ionomer, dendrimer, or a combination comprising at least one of the foregoing types of organic polymers. The organic polymer may also be a blend of polymers, copolymers, terpolymers, or the like, or a combination comprising at least one of the foregoing types of organic polymers.

Examples of suitable organic polymers are natural and synthetic waxes and fatty esters, polyacetals, polyolefins, polyesters, polyaramides, polyarylates, polyethersulfones, polyphenylene sulfides, polyetherimides, polytetrafluoroethylenes, polyetherketones, polyether etherketones, polyether ketone ketones, polybenzoxazoles, polyacrylics, polycarbonates, polystyrenes, polyamides, polyamideimides, polyarylates, polyurethanes, polyarylsulfones, polyethersulfones, polyarylene sulfides, polyvinyl chlorides, polysulfones, polyetherimides, or the like, or a combinations comprising at least one of the foregoing polymeric resins.

Blends of organic polymers can be used as well. Examples of suitable blends of organic polymers include acrylonitrile-butadiene styrene, acrylonitrile-butadiene-styrene/nylon, polycarbonate/acrylonitrile-butadiene-styrene, polyphenylene ether/polystyrene, polyphenylene ether/polyamide, polycarbonate/polyester, polyphenylene ether/polyolefin, and combinations comprising at least one of the foregoing blends of organic polymers.

Exemplary organic polymers are acrylonitrile-butadiene styrene (ABS), natural and synthetic waxes and fatty esters, and ultraviolet (UV)) cured acrylates. Examples of suitable synthetic wax compounds are n-alkanes, ketones, secondary alcohols, beta-diketones, monoesters, primary alcohols, aldehydes, alkanoic acids, dicarboxylic acids, omega-hydroxy acids having about 10 to about 38 carbon atoms. Examples of suitable natural wax compounds are animal waxes, vegetal waxes, and mineral waxes, or the like, or a combination comprising at least one of the foregoing waxes. Examples of animal waxes are beeswax, Chinese wax (insect wax), Shellac wax, whale spermacetti, lanolin, or the like, or a combination comprising at least one of the foregoing animal waxes. Examples of vegetal waxes are carnauba wax, ouricouri wax, jojoba wax, candelilla wax, Japan wax, rice bran oil, or the like, or a combination comprising at least one of the foregoing waxes. Examples of mineral waxes are ozocerite, Montan wax, or the like, or a combination comprising at least one of the foregoing waxes.

As noted above, the disposable insert can be manufactured from thermosetting or crosslinked polymers such as, for example, UV cured acrylates. Examples of crosslinked polymers include radiation curable or photocurable polymers. Radiation curable compositions comprise a radiation curable material comprising a radiation curable functional group, for example an ethylenically unsaturated group, an epoxide, and the like. Suitable ethylenically unsaturated groups include acrylate, methacrylate, vinyl, allyl, or other ethylenically unsaturated functional groups. As used herein, "(meth)acrylate" is inclusive of both acrylate and methacrylate functional groups. The materials can be in the form of monomers, oligomers, and/or polymers, or mixtures thereof. The materials can also be monofunctional or polyfunctional, for example di-, tri-, tetra-, and higher functional materials. As used herein, mono-, di-, tri-, and tetrafunctional materials refers to compounds having one, two, three, and four radiation curable functional groups, respectively.

Exemplary (meth)acrylates include methyl acrylate, tert-butyl acrylate, neopentyl acrylate, lauryl acrylate, cetyl acrylate, cyclohexyl acrylate, isobornyl acrylate, phenyl acrylate, benzyl acrylate, o-toluyl acrylate, m-toluyl acrylate, p-toluyl acrylate, 2-naphthyl acrylate, 4-butoxycarbonylphenyl acrylate, 2-methoxy-carbonylphenyl acrylate, 2-acryloyloxyethyl-2-hydroxypropyl phthalate, 2-hydroxy-3-phenoxypropyl acrylate, ethyl methacrylate, n-butyl methacrylate, sec-butyl methacrylate, isobutyl methacrylate, propyl methacrylate, isopropyl methacrylate, n-stearyl methacrylate, cyclohexyl methacrylate, 4-tert-butylcyclohexyl methacrylate, tetrahydrofurfuryl methacrylate, benzyl methacrylate, phenethyl methacrylate, 2-hydroxyethyl methacrylate, 2-hydroxypropyl methacrylate, glycidyl methacrylate, and the like, or a combination comprising at least one of the foregoing (meth)acrylates.

The organic polymer may also comprise an acrylate monomer copolymerized with another monomer that has an unsaturated bond copolymerizable with the acrylate monomer. Suitable examples of copolymerizable monomers include styrene derivatives, vinyl ester derivatives, N-vinyl derivatives, (meth)acrylate derivatives, (meth)acrylonitrile derivatives, (meth)acrylic acid, maleic anhydride, maleimide derivatives, and the like, or a combination comprising at least one of the foregoing monomers.

An initiator can be added to the insert casting composition in order to activate polymerization of any monomers present. The initiator may be a free-radical initiator. Examples of suitable free-radical initiators include ammonium persulfate, ammonium persulfate and tetramethylethylenediamine mixtures, sodium persulfate, sodium persulfate and tetramethylethylenediamine mixtures, potassium persulfate, potassium persulfate and tetramethylethylenediamine mixtures, azobis [2-(2-imidazolin-2-yl) propane] HCl (AZIP), and azobis(2-amidinopropane) HCl (AZAP), 4,4'-azo-bis-4-cyanopentanoic acid, azobisisobutyramide, azobisisobutyramidine.2HCl, 2-2'-azo-bis-2-(methylcarboxy) propane, 2-hydroxy-1-[4-(hydroxyethoxy) phenyl]-2-methyl-1-propanone, 2-hydroxy-2-methyl-1-phenyl-1-propanone, or the like, or a combination comprising at least one of the aforementioned free-radical initiators. Some additives or comonomers can also initiate polymerization, in which case a separate initiator may not be desired. The initiator can control the reaction in addition to initiating it. The initiator is used in amounts of about 0.005 wt % and about 0.5 wt %, based on the weight of the insert casting composition.

Other initiator systems, in addition to free-radical initiator systems, can also be used in the insert casting composition. These include ultraviolet (UV), x-ray, gamma-ray, electron beam, or other forms of radiation, which could serve as suitable polymerization initiators. The initiators may be added to the insert casting composition either during the manufacture of the insert casting composition or just prior to casting.

Dispersants, flocculants, and suspending agents can also be optionally added to the insert casting composition to control the flow behavior of the composition. Dispersants make the composition flow more readily, flocculants male the composition flow less readily, and suspending agents prevent particles from settling out of composition. These additives are generally used in amounts of about 0.01 to about 10 wt %, of the total weight of the ceramic or metal powder in the insert casting composition.

As noted above, the integral casting core may be further used for molding metal castings. In one exemplary embodiment, the disposable inserts may be used for manufacturing turbine components. These turbine components can be used in either power generation turbines such as gas turbines, hydroelectric generation turbines, steam turbines, or the like, or they may be turbines that are used to facilitate propulsion in aircraft, locomotives, or ships. Examples of turbine components that may be manufactured using disposable inserts are stationary and/or rotating airfoils. Examples of other turbine components that may be manufactured using disposable inserts are seals, shrouds, splitters, or the like.

Disposable inserts have a number of advantages. They can be mass produced if desired and widely used in casting operations for the manufacture of turbine airfoils. The disposable insert can be mass produced at a low cost. The disposable insert can be manufactured in simple or complex shapes. The use of a disposable insert can facilitate the production of the integral casting core without added assembly or manufacturing. This results in lower costs for the manufacturing of components having intricate internal designs.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A method of forming an integral casting core comprising:

adding a disposable insert to a metal core die, wherein the disposable insert defines a partition wall in a double wall airfoil;

disposing a slurry into the metal core die; wherein the slurry comprises ceramic particles;

firing the slurry to form an integral casting core, wherein the integral casting core is formed via a single step of disposing the slurry into the metal core die; and removing the disposable insert from the integral casting core.

2. The method of claim 1, wherein the removal of the disposable insert is accomplished via chemical dissolution, chemical degradation, mechanical abrasion, melting, thermal degradation or a combination comprising at least one of the foregoing methods of removing.

3. The method of claim 1, wherein the disposable insert is manufactured by a rapid prototyping process.

4. The method of claim 1, further comprising curing the slurry to form a cured ceramic core.

5. The method of claim 4, wherein the curing of the slurry is conducted prior to the firing of the slurry.

6. The method of claim 1, wherein the removal of the disposable insert comprises degrading the disposable insert.

7. The method of claim 1, further comprising disposing the integral casting core into a wax die; wherein the wax die comprises a metal.

8. The method of claim 7, further comprising injecting a wax into the wax die to form a wax component.

9. The method of claim 8, further comprising immersing the wax component into a slurry to form an outer shell; and firing the wax component with the outer shell to form a ceramic shell.

10. The method of claim 8, wherein the slurry comprises a ceramic.

11. The method of claim 8, further comprising removing the wax from the outer shell and the wax component.

12. The method of claim 11, further comprising disposing a molten metal into the outer shell.

13. The method of claim 12, further comprising removing the outer shell and an integral casting core to yield a molded component.

14. A double wall airfoil comprising a partition wall manufactured by the method of claim 1.

15. The double wall airfoil of claim 14, wherein the double wall airfoil is a turbine component.

16. A method comprising:

adding a disposable insert to a metal core die; wherein the disposable insert comprises a wax and defines a partition wall in a double wall airfoil;

disposing a slurry in to the metal core die; wherein the slurry comprises ceramic particles;

firing the slurry in a first firing process to form an integral casting core; wherein the disposable insert is removed from the integral casting core during the firing of the slurry, and wherein the integral casting core is formed via a single step of disposing the slurry into the metal core die;

disposing the integral casting core into a wax die; wherein the wax die comprises a metal surface;

injecting a wax into the wax die to form a wax component;

immersing the wax component into a slurry to form an outer shell;

firing the wax component with the outer shell in a second firing process to form a ceramic shell;

removing the wax from the outer shell and the wax component;

disposing a molten metal into the outer shell; and removing the outer shell to yield a molded component.

17. The method of claim 16, wherein the molded component is a turbine airfoil.

18. The method of claim 16, wherein the disposable insert comprises a wax.

19. The method of claim 16, wherein the disposable insert comprises an organic polymer.

20. The method of claim 19, wherein the organic polymer is a thermoplastic polymer, a thermo setting polymer, a blend of thermoplastic polymers, or blends of thermoplastic polymers with thermo setting polymers.

21. The method of claim 19, wherein the organic polymer is a homopolymer, a copolymer, a star block copolymer, a graft copolymer, an alternating block copolymer, a random copolymer, an ionomer, a dendrimer, or a combination comprising at least one of the foregoing types of organic polymers.

22. The method of claim 21, wherein the organic polymer is a blend of polymers, copolymers, terpolymers, or a combination comprising at least one of the foregoing types of organic polymers.

* * * * *